United States Patent [19]

Tamaru et al.

[11] 4,271,493

[45] Jun. 2, 1981

[54] ELECTRONIC TIMEPIECE

[75] Inventors: Munetaka Tamaru, No. 32-18, 2-chome, Igusa, Suginami-ku, Tokyo; Toshikazu Hatuse, No. 23-10, 4-chome, Shibakubo-cho, Tanashi-shi, Tokyo, both of Japan

[73] Assignee: Citizen Watch Co., Ltd., Tokyo, Japan

[21] Appl. No.: 50,109

[22] Filed: Jun. 19, 1979

Related U.S. Application Data

[63] Continuation-in-part of Ser. No. 883,576, Mar. 6, 1978, abandoned.

[30] Foreign Application Priority Data

Mar. 8, 1977 [JP] Japan ..... 52/24418

[51] Int. Cl.[3] ..... G04B 19/24

[52] U.S. Cl. ..... 368/28; 368/37; 368/38

[58] Field of Search ..... 58/4 A, 23 R, 23 D, 58/58, 16, 19 R, 129, 130 E, 130 C; 310/40 R, 40 M, 49 R; 318/138, 696; 368/28, 37, 38

[56] References Cited

U.S. PATENT DOCUMENTS

| | | | |
|---|---|---|---|
| 3,875,739 | 4/1975 | Mougin | 58/58 |
| 3,945,191 | 3/1976 | van Berkum | 58/58 X |
| 4,129,981 | 12/1978 | Nomura et al. | 58/23 D |

*Primary Examiner*—Ulysses Weldon

[57] ABSTRACT

A drive mechanism for an additional mechanism of an electronic timepiece having a time-keeping system driven by a reversible stepping motor, in which an auxiliary driving source is arranged to accumulate energy utilizing a drive power transmitted from a time-keeping system for driving additional mechanism, and locking means maintains the energy stored in the auxiliary driving source.

4 Claims, 7 Drawing Figures

ELECTRONIC TIMEPIECE

REFERENCE TO PRIOR APPLICATION

This is a continuation in part of patent application Ser. No. 883,576 filed on Mar. 6, 1978 and now abandoned.

FIELD OF INVENTION

This invention relates to a mechanism for driving a calendar device or the like installed in an electronic timepiece as an additional mechanism.

BACKGROUND OF THE INVENTION

In the past, driving such a device as a calendar installed in a mechanical or electronic analog timepiece was accomplished by adopting a system in which a date dial or the like was driven by means of driving power obtained from a portion of a wheel train. In accordance with this method, it was necessary to provide a driving source which, in the case an electronic timepiece, constantly delivered more power than was actually necessary to drive a date wheel or the like by means of an electro-mechanical transducer, and it was therefore required to provide sufficient power margin when designing the timepiece. As a result, these systems were defective since the transducer consumed too much power. Furthermore, it was difficult to design a mechanism which could instantly switch over a display since driving was accomplished by means of the wheel train.

SUMMARY OF THE INVENTION

Accordingly, it is an object of the present invention to provide an electronic timepiece having a calendar device, wherein instant display change-over is made possible through joint use of a source for driving an additional mechanism and a source for driving the time display.

BRIEF DESCRIPTION OF DRAWINGS

This and other objects, features and advantages of the present invention will become more apparent from the following description when taken in conjunction with the accompanying drawings, in which.

DESCRIPTION OF PREFERRED EMBODIMENT

Figure 1:
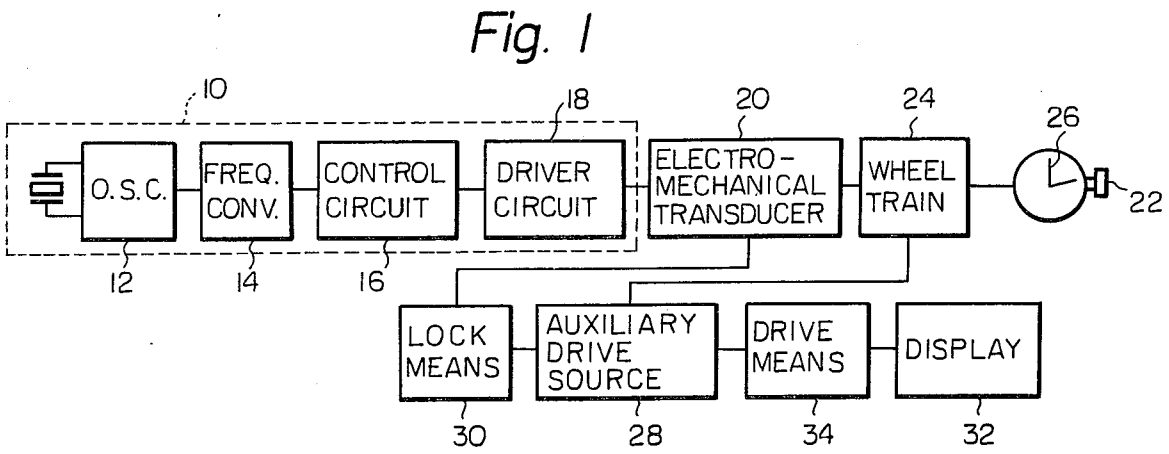
FIG. 1 is a block wiring diagram showing the basic structure of the present invention.

Referring now to FIG. 1, an electronic circuitry block 10 comprises an oscillator circuit 12 providing a relatively high frequency signal, frequency divider circuit 14 responsive to the relatively high frequency signal to provide a plurality of low frequency signals, control circuit 16 responsive to the low frequency signals to provide an output signal and a control signal once in every 24 hours (24 hour signal), and a driver circuit 18 responsive to the output signal to normally provide clockwise drive signals and responsive to the control signal to provide a counter-clockwise drive signal once every 24 hours, i.e., at 12 o'clock midnight. An electro-mechanical transducer 20 comprises a reversible stepping motor which is normally responsive to the clockwise drive signals to rotate in the clockwise direction and also responsive to the counter-clockwise drive signals to rotate in the counter-clockwise direction. An external control member 22 is provided for performing time correction when actuated. The external control member 22 does not constitute an essential part of the present invention and, therefore, a detailed description of the same as herein omitted. A wheel train 24 transmits the driving power of the transducer to a first display device 26 such as the hands of a watch, thereby enabling a display of time. An auxiliary driving source designated at 28 is drivably connected to the wheel train 24. A locking means designated at 30 is adapted to be operated by the transducer 20 to hold the auxiliary driving source 28 in the locked state. When the auxiliary driving source 28 is released from the locked state due to counter-clockwise rotation of the transducer 20, there is an accompanying release of energy which advances a second display device 32 such as the date wheel of a calendar by means of a drive means 34. In accordance with the structure of the present invention, energy is always stored in small amounts in the auxiliary driving source through the wheel train 24. Since the auxiliary driving source is released from the hold of locking means 30 by the counter-clockwise rotation of the transducer, the release of energy makes it possible to instantaneously advance the date wheel of the calendar device. Furthermore, if the pulses which induce the counter-clockwise rotation of the electro-mechanical transducer 20 are inserted between the pulses for clockwise rotation, efficiency can be enhanced since releasing the hold of the locking means will not present an excessive load.

Figure 2A:
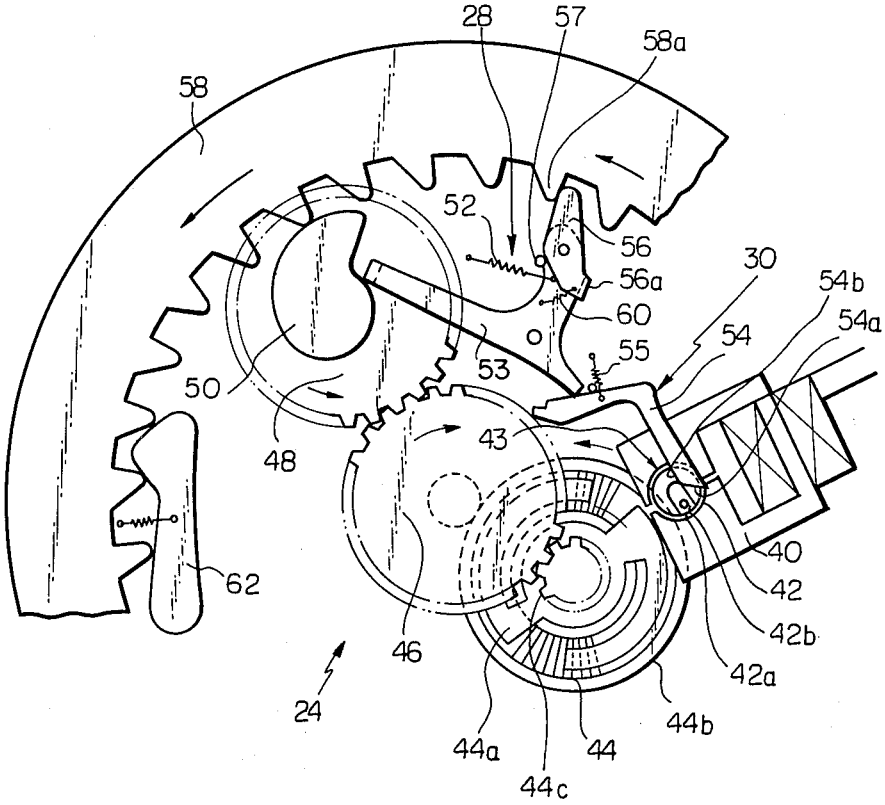
FIG. 2A is a plan view of a preferred embodiment of the basic structure illustrated in FIG. 1.

In FIG. 2A which shows a preferred embodiment of the fundamental structure of the present invention, the transducer 20 comprises a stepping motor 40 capable of rotation in the clockwise and counter-clockwise directions drives the wheel train 24 composed of a seconds wheel (not shown) adapted to be driven through a wheel 44, a minutes wheel (not shown), and an hours wheel 46 adapted to be rotated once every 24 hours due to the clockwise rotation of the stepping motor 40.

Figure 2B:
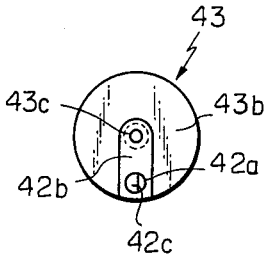
FIG. 2B is a plan view showing the relationship between a rotor assembly and a cam element.
Figure 2C:
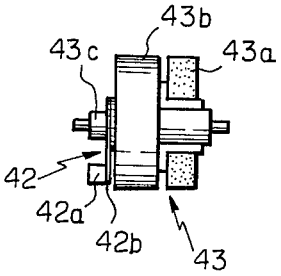
FIG. 2C is a side view of the rotor assembly shown in FIG. 2B.
Figure 2D:
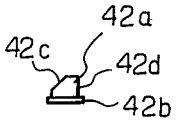
FIG. 2D is an enlarged side view of the cam element shown in FIG. 2B.

As shown in FIGS. 2B to 2C, the stepping motor 40 comprises a rotor assembly 43 composed of a rotor magnet **43*a* fixedly mounted on a rotor shaft 43*c*, and a pinion 43*b* fixedly mounted on the rotor shaft 43*c*. The rotor assembly 43 carries a cam 42, which comprises a spring arm 42*b* fixedly secured at its one end to the rotor shaft 43*c* and radially extending therefrom, and a cam element 42*a* attached to the other end of the spring arm 42*b*. The cam element 42*a* has a slanted surface 42*c*. The spring arm 42*b* is axially deflectable when the axial force is applied to the cam element 42*a* in a manner as will be described in detail. The pinion 43*b* rotates the wheel 44, which comprises a first gear 44*b* in meshing engagement with the pinion 43*b* of the rotor assembly 43, a second gear 44*c* concentric with the first gear, and a ratchet mechanism 44*a* disposed between the first and second gears 44*b* and 44*c* and operable to provide a drive connection between the first and second gears 44*b*** and 44c during clockwise rotation of the rotor assembly 43 and interrupt drive connection between the first and second gears 44b and 44c during counter-clockwise rotation of the rotor assembly 43. A transmission wheel 48 in engagement with hour wheel 46, and a winding cam 50 provided on the transmission wheel 48, rotate once every 24 hours, thereby storing an energy in auxiliary drive source 28. In FIG. 2A, the drive source 28 is shown as a spring 52 which is tensioned by the action of cam 50 for winding a date wheel advance lever 53, the tensioned state being maintained by means of locking means 30 which is shown as a lever 54. The tip of the date wheel advance lever 53 cooperates with a drive lever 56 which engages with pawls 58a of the date wheel 58 and advances the date wheel 58 by one day when the hold of the locking lever 54 is released. During a winding stroke, lever 56 rides over the pawls 58a, the tip of the lever 56 being tensioned by a weak spring 60. During this interval the date wheel 58 is held in position by a holding lever 62. As described above, date wheel advance lever 54 tensioned by winding cam 50 is held in the tensioned state by locking lever 54; however, when stepping motor 40 is caused to rotate in the counter-clockwise direction due to the arrival of a 24-hour signal from the driver circuit 18, engaging surface 42d of cam 42 abuts against the surface 54a of lever 54 to release locking lever 54 so that the date wheel 58 is advanced by one day due to the operation of the date wheel advance lever 53 and drive lever 56 which engages with the date wheel pawls 58a. Indicated as 56a is a projection of the lever 56 which engages the lever 53. Reference numeral 57 is a stop pin, and 55 a biasing spring. During clockwise rotation of the rotor assembly 43, the slanted surface 42c of the cam element 42a engages the side surface 54b of locking lever 54 and the cam element 42a is caused to move downward, as viewed in FIG. 2A, by means of spring arm 42b. Thus, the cam element 42a does not affect the locking lever 54 during clockwise rotation of the rotor assembly.

In the present embodiment, the spring 52 of the date wheel advance lever 53 is biased by the hour wheel 46. However, this poses no restriction since any of the wheels in the timekeeping system may be employed. Further, the locking lever 54 in the present embodiment is adopted so as to be constantly engaged during clockwise rotation; however, it may be convenient to adopt a structure in which the lever is engaged only during counter-clockwise rotation in order to reduce the load.

Although the additional mechanism described in the present embodiment is a calendar mechanism, the present invention may also be applied to an alarm mechanism for an alarm clock. If the structure of the invention is adapted so as not to require a month-end correction, the date advance can conveniently be instantaneously accomplished by means of electric signals.

A principal concept of the present invention as illustrated in FIG. 1 may be modified and applied to a timepiece having a calendar which does not require a month-end correction for even-numbered months. In this case, the display device 32 is the date wheel 58. If the date of February 28 is considered, the auxiliary drive source 28 is adapted to accumulate enough energy to advance the date wheel by four days, and the circuitry which drives the electro-mechanical transducer 20 is arranged to produce signals which induce counter-clockwise rotation to release locking means 30, these signals being generated twice in the case of an even-numbered month of 30 days, three times in the case of a date of February 29 in a leap year, and four times for a date of February 28. Accordingly, in the case of an even-numbered month, locking means 30 will be released twice during the night of the 30th day, the energy stored in the auxiliary driving source 28 causing two pawls 58a of the date wheel 58 to advance, thereby setting the date to the first day of the following month.

Figure 3A:
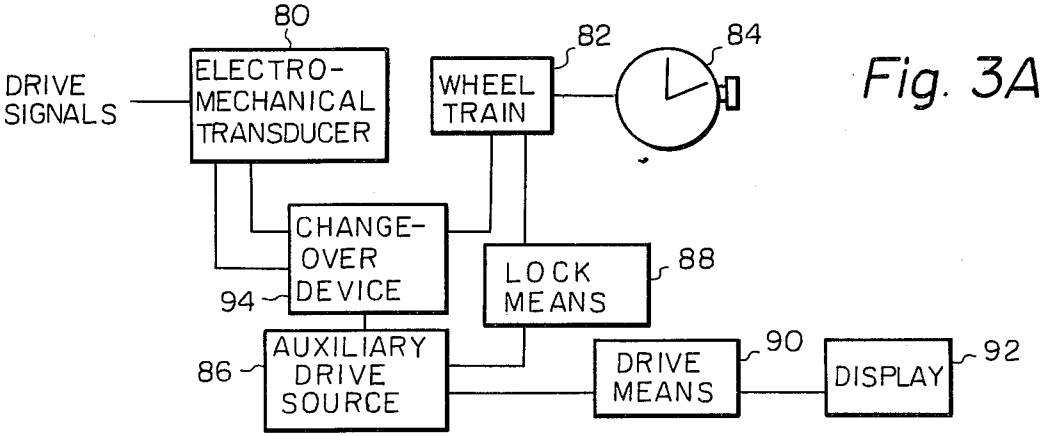
FIG. 3A is a block wiring diagram of another preferred embodiment according to the present invention.

FIG. 3A is a block wiring diagram of another preferred embodiment in accordance with the present invention, and comprises an electro-mechanical transducer 80, wheel train 82, first display device 84, auxiliary driving source 86, locking means 88, driving device 90, second display device 92, and a change-over device 94. The transducer 80 is constructed so as to be rotatable in the clockwise and counter-clockwise directions responsive to drive signals from a driver circuit (not shown). The clockwise rotation of the transducer is transmitted by wheel train 82 and drives the hands of the display device 84 so as to permit a display of time. On the other hand, the counter-clockwise rotation of the transducer stores energy in the auxiliary driving source 86, such as a spring or secondary battery, upon the disengagement of the clock system wheel train 82 by means of the changeover device 94. Locking means 88 holds the auxiliary source in the ready state, and releases the auxiliary source in response to a signal which arrives from the clock system wheel train 82 every 24 hours. The energy stored in auxiliary driving source 86 is thereby released, allowing the actuation of driving device 90 which permits display device 92 (a calendar date wheel in the present embodiment) to instantaneously advance by one day.

Figure 3B:
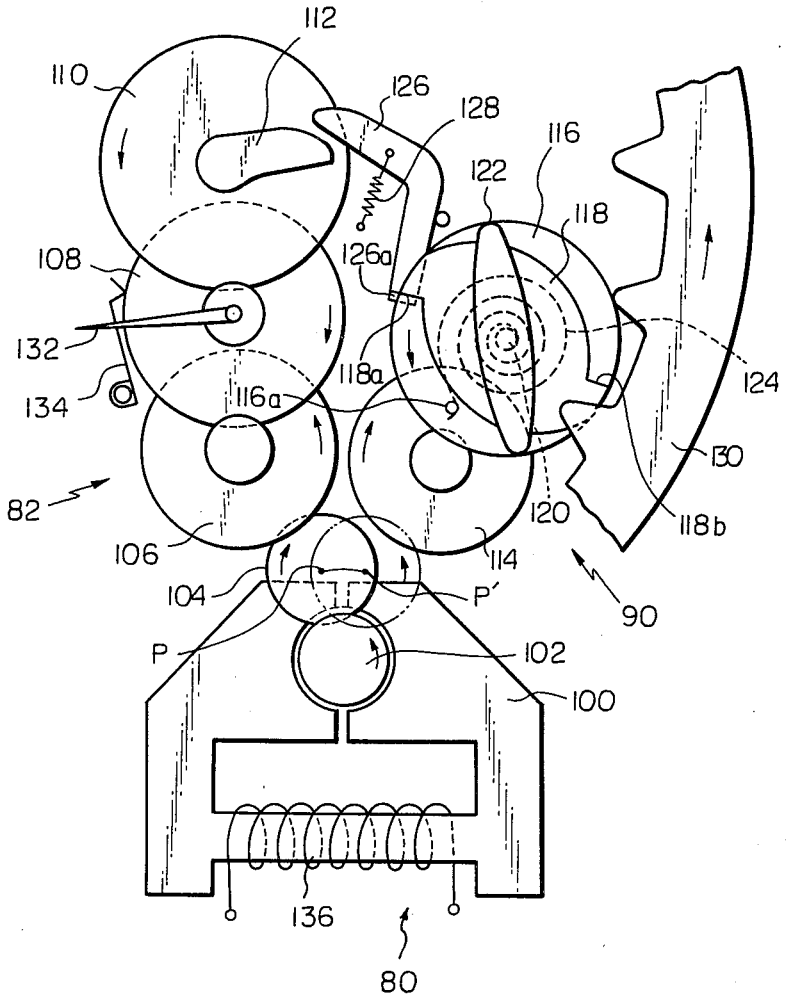
FIG. 3B is a plan view of a preferred embodiment of the basic structure illustrated in FIG. 3B.

FIG. 3B shows a detailed structure of the embodiment of FIG. 3A. In FIG. 3B, the electro-mechanical transducer 80 comprises a reversible stepping motor which includes stator pole pieces 100, a driving coil 136, and a rotor 102. The rotor 102 has a pinion (not shown) which is held in meshing engagement with a reverser wheel 104. The reverser wheel 104 assumes a position P during counter-clockwise rotation of the rotor 102 and assumes a position P' during the clockwise rotation of the rotor 102. Thus, the axial position of the reverser wheel 104 is changed over in dependence on the rotational direction of the rotor 102, thereby providing drive connection between the rotor 102 and the wheel train 82 for the timekeeping mechanism and providing drive connection between the rotor 102 and the drive means 90. The wheel train 82 comprises an intermediate wheel 106 engageable with the reverser wheel 104, a gear wheel 108 meshing with the intermediate wheel 106, and a transmission wheel 110. The gear wheel 108 actuates an hours wheel (not shown) through which a time indicating hand 132 is actuated. Indicated at 134 is a spring which prevents undesired reverse rotation of the hand 132 during changing over period of the reverser wheel 106. The transmission wheel 110 is rotated once every 24 hours by the hours wheel. A cam 112 is integrally mounted on the transmission wheel 110, to release a lock lever 126. When the reverser wheel 104 assumes the position P', it engages with an intermediate wheel 114 which has a pin 116a to which one end of a coil spring 124 is connected. During counter-clockwise rotation of the rotor 102, the intermediate wheel 114 is rotated clockwise to wind the coil spring 124. The coil spring 124 has its another end connected to an central axis 120 of winding gear wheel 116. The winding gear wheel 116 has cam surfaces 118a and 118b, the cam surface 118a bearing engaging portion 126a of the locking lever 126, which is held in its locked state by the action of a tension spring 128. Thus, since the winding wheel 116 is held in a fixed condition by the action of the locking lever 126, the coil spring 124 is wound to store a mechanical energy by the action of the intermediate wheel 114 driven by reverse rotation of the rotor 102. Under these conditions, when the transmission wheel 110 is caused to rotate once every 24 hours, the cam 112 engages the locking lever 126. In this instance, the locking lever 126 is rotated clockwise so that the engaging portion 126*a* of the locking lever 126 disengages from and release the winding wheel 116. Accordingly, the cam 122 quickly rotates counter-clockwise to quickly actuate the calendar dial 130 counter-clockwise.

While the present invention has been shown and described with reference to particular embodiments, it should be noted that various other changes or modifications may be made without departing from the scope of the present invention.

What is claimed is:

1. In an electronic timepiece powered by a battery and having a first display device to provide a display of current time information and a second display device to provide a display of additional information other than said current time information, the improvement comprising:

an oscillator circuit providing a relatively high frequency signal;

a frequency divider circuit responsive to said relatively high frequency signal to provide a plurality of low frequency signals;

a control circuit responsive to said plurality of low frequency signals to provide an output signal, said control circuit being also responsive to said low frequency signals to provide a control signal every 24 hours;

a driver circuit normally responsive to said output signal to provide a first drive signal, said driver circuit being also responsive to said control signal to provide a second drive signal;

an electro-mechanical transducer responsive to said first drive signal to actuate said first display device in one direction to provide said display of current time information, said electro-mechanical transducer being also responsive to said second drive signal to rotate in another direction;

a wheel train driven by said electro-mechanical transducer to actuate said first display device;

an auxiliary driving source drivably connected to said wheel train, said auxiliary driving source including means for accumulating energy by the action of said wheel train;

locking means for normally holding said auxiliary driving source in a locked state, said locking means being released by said electro-mechanical transducer when it is rotated in said another direction in response to said second drive signal, for thereby releasing energy of said auxiliary driving source;

drive means powered by said auxiliary driving source and actuating said second display device when said auxiliary driving source is released by said locking means.

2. The improvement as set forth in claim 1, wherein said auxiliary driving source comprises a spring member.

3. In an electronic timepiece powered by a battery and having a first display device to provide a display of current time information and a calendar dial to actuate a second display device to provide a display of additional information other than said current time information, the improvement comprising:

an oscillator circuit providing a relatively high frequency signal;

a frequency divider circuit responsive to said relatively high frequency signal to provide a plurality of low frequency signals;

a control circuit responsive to said plurality of low frequency signals to provide an output signal, said control circuit being also responsive to said low frequency signals to provide a control signal every 24 hours;

a driver circuit normally responsive to said output signal to provide a first drive signal, said drive circuit being also responsive to said control signal to provide a second drive signal;

an electro-mechanical transducer responsive to said first drive signal to actuate said first display device in one direction to provide said display of current time information, said electro-mechanical transducer being also responsive to said second drive signal to rotate in another direction;

a wheel train including an intermediate wheel driven by said electro-mechanical transducer when it is rotated in said one direction in response to said first drive signal, an hours wheel driven by said intermediate wheel to actuate said first display device and a transmission wheel engaging said hours wheel to be rotatable therewith;

a winding cam provided on said transmission wheel for rotation therewith;

a calendar wheel advance lever having one end portion engaging said winding cam to be actuated by the action of said winding cam, and another end portion;

an auxiliary driving source which accumulates energy by the action of said calendar wheel advance lever; and a locking lever for normally holding said calendar wheel advance lever in a locked state, said locking lever being released by said electro-mechanical transducer when it is rotated in said another direction in response to said second driving signal, for thereby releasing energy of said auxiliary driving source, whereby said calendar wheel advance lever actuates said calendar wheel by which said second display device is actuated to provide said display of said additional information.

4. In an electronic timepiece powered by a battery and having a first display device to provide a display of current time information and a calendar wheel to actuate a second display device to provide a display of additional information other than said current time information, the improvement comprising:

an oscillator circuit providing a relatively high frequency signal;

a frequency divider circuit responsive to said relatively high frequency signal to provide a plurality of low frequency signals;

a control circuit responsive to said plurality of low frequency signals to provide an output signal;

a driver circuit responsive to said output signal to provide a first drive signal and a second drive signal;

an electro-mechanical transducer including a rotor and responsive to said first drive signal to rotate said rotor in one direction, said electro-mechanical transducer being also responsive to said second drive signal to rotate said rotor in another direction;

a reverser wheel driven by the rotor of said electro-mechanical transducer, said reverser wheel having an axial position held in one location when said rotor is rotated in said one direction and held in another location when said rotor is rotated in said another direction;

a wheel train drivably connectable to said reverser wheel when the axial position of said reverser wheel is in said one location to receive a driving power from said electro-mechanical transducer to actuate said first display device, said wheel train including a transmission wheel which completes one revolution within 24 hours, and cam means integral with said transmission wheel;

a driving device drivably connectable to said reverser wheel when said electro-mechanical transducer is rotated in said another direction;

an auxiliary driving source for accumulating energy by the action of said driving device;

a lock lever normally holding said driving device in a locked state by the action of said auxiliary driving source, said lock lever being released by said cam means once every 24 hours, for thereby releasing energy of said auxiliary driving source whereby said driving device rotates said calendar wheel to cause said second display device to provide the display of said additional information.

* * * * *